US007584810B1

(12) United States Patent
McKnight, Jr. et al.

(10) Patent No.: US 7,584,810 B1
(45) Date of Patent: Sep. 8, 2009

(54) TOP DRIVE POWER SWIVEL ASSEMBLY

(75) Inventors: Thomas Nelson McKnight, Jr., Austin, TX (US); Sammy Kent Flud, Midland, TX (US)

(73) Assignee: Eagle Rock Manufacturing, LLC, Midland, TX (US)

( * ) Notice: Subject to any disclaimer, the term of this patent is extended or adjusted under 35 U.S.C. 154(b) by 158 days.

(21) Appl. No.: 11/868,687

(22) Filed: Oct. 8, 2007

(51) Int. Cl.
*E21B 19/08* (2006.01)

(52) U.S. Cl. ..... 175/162; 175/189

(58) Field of Classification Search ..... 175/122, 175/162, 189, 220
See application file for complete search history.

(56) References Cited

U.S. PATENT DOCUMENTS 6,412,576 B1 * 7/2002 Meiners ..... 175/57
6,672,410 B2 * 1/2004 Smith ..... 175/122

* cited by examiner

*Primary Examiner*—David Bagnell
*Assistant Examiner*—Catherine Loikith
(74) *Attorney, Agent, or Firm*—Buskop Law Group, PC; Wendy Buskop

(57) ABSTRACT

A top drive power swivel assembly for well drilling rigs having a travelling frame for moving along a drilling tower. The travelling frame has at least two lower and two upper travelling frame extensions. A housing has at least two upper and two lower housing extensions each with an opening. A first connector penetrates openings of upper travelling frame extensions and openings of an upper housing extensions engaging the travelling frame to the housing. A second connector penetrates openings of lower travelling frame extensions and openings of lower housing extensions to securely engage the travelling frame to the housing. A top drive power swivel mounts to the housing and the top drive power swivel receives power from hydraulic motors. Various sheave assemblies mounted to the travelling frame engage a hoisting means. Guide wheel assemblies disposed on the travelling frame engage the tubulars.

13 Claims, 6 Drawing Sheets

TOP DRIVE POWER SWIVEL ASSEMBLY

FIELD

The present embodiments relate to machinery and methods for exploring beneath the earth's surface and, more particularly, to stratigraphic exploration.

BACKGROUND

A need exists for methods and machinery useful on a drilling rig that allows drilling through consolidated surfaces that can be accomplished quickly, efficiently, economically and with as little disruption as possible at a field site.

A further need exists for a top drive power swivel assembly that mates to a travelling frame for forming an integrated travelling frame swivel assembly that is more secure, more stable than currently available power swivels that do not mate to the frame.

The present embodiments meet these needs.

BRIEF DESCRIPTION OF THE DRAWINGS

The detailed description will be better understood in conjunction with the accompanying drawings as follows.

Figure 1:
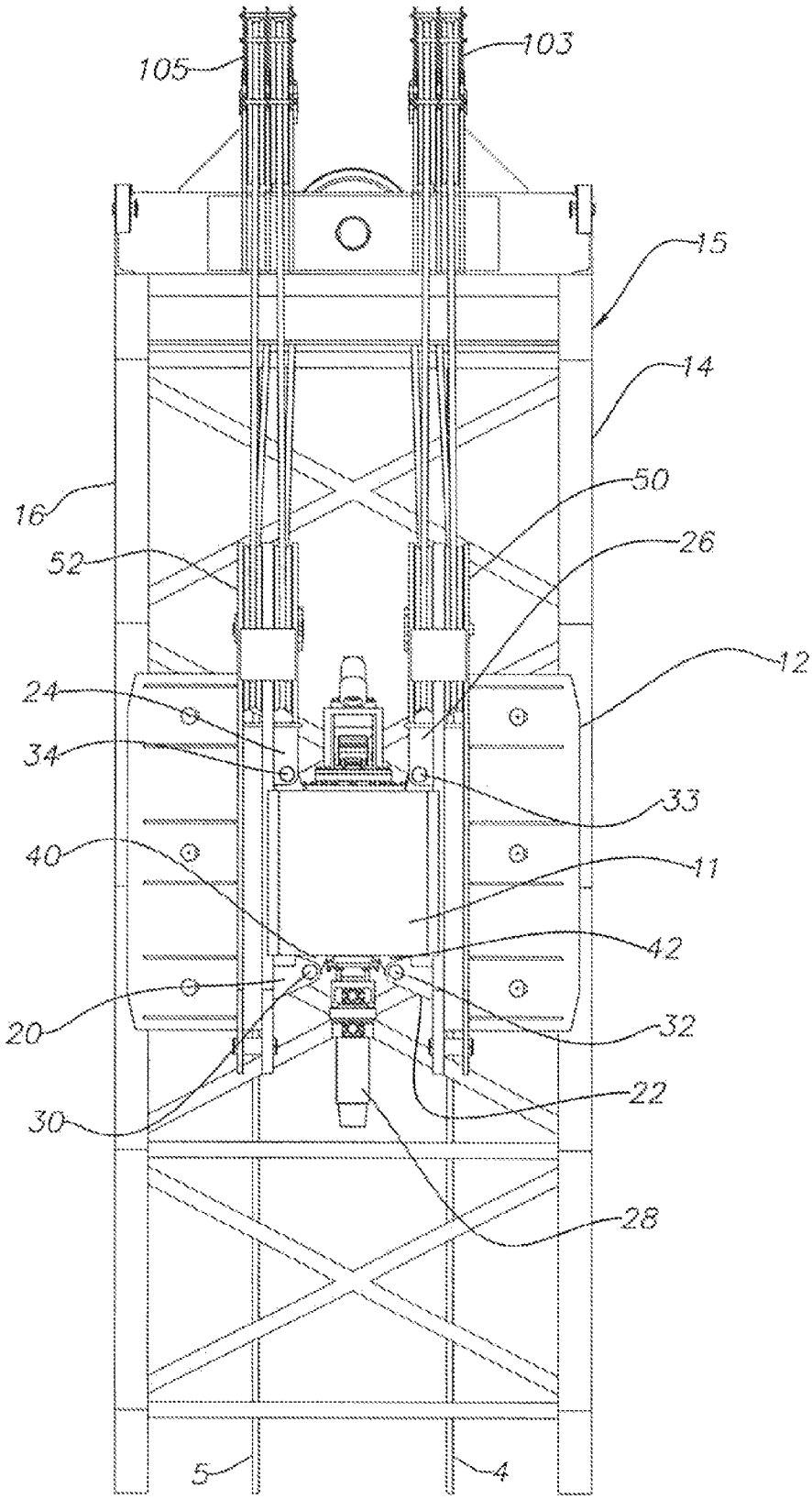
FIG. 1 is a front view of the top drive power swivel assembly mated to a travelling frame using a connector embodiment of the invention.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a top drive power swivel assembly for a drilling rig, such as mobile drilling rig for drilling for natural gas, oil, or water.

The invention provides a top drive power swivel assembly accommodating the needs listed above for use with a structurally moveable tower or derrick, having a drilling rig mast.

Another benefit of an embodiment of the invention is that it provides a means for attaching the power swivel to the traveling frame assembly that is mechanically stabilized by upper and lower attachment points.

The inventive top drive power swivel assembly has a travelling frame for moving along at least two tubulars which are part of a tower. The tubulars can be legs of a tower or a derrick. The tubulars can be a set of rails installed on the legs of a derrick, such as a set of steel rails welded to the front of the derrick The travelling frame has at least two lower travelling frame extensions, a first and second lower travelling frame extensions and two upper travelling frame extensions, at least a first and second upper travelling frame extensions. In an embodiment, 4 upper travelling frame extensions can be contemplated for use, one at each corner of the travelling frame nearest the top drive power swivel. The lower travelling frame extensions can be contemplated to having a triangular shape with rounded edges and an opening or eye in the portion of the extension furthest from the travelling frame. These triangular in shape extensions are contemplated to be mounted horizontally to the axis used by the travelling frame for moving up and down the derrick. This means, that the extensions point towards the top drive power swivel in this embodiment.

The top drive power swivel can have a housing for holding the top drive power swivel components.

The housing has at least two upper housing extensions and in an embodiment, at least four upper housing extensions. Additionally, the housing has at least two lower housing extensions, and in the embodiment shown in FIG. 6 at least four lower housing extensions.

Each extension has an opening. The openings can be round or ellipsoidal, as long as the opening can accommodate a connector. The openings have a diameter from about 1 inch to about 6 inches. The connector can be a pin, the pin can be a solid steel rod. The pin can extend across the housing to engage at least two housing extensions disposed in parallel with at least two travelling frame extensions.

A first connector can be used to penetrate at least one of the openings in an upper travelling frame extension and at least one opening in an upper housing extension simultaneously, thereby securely engaging the travelling frame to the housing with the extensions. It is contemplated that the extensions can be welded or otherwise fastened to each component.

A second connector can be used to penetrate at least one opening in a lower travelling frame extension and at last one opening in a lower housing extension, again simultaneously. Simultaneously, in this application, means both extensions are held together at the same time using the connector to securely engage the travelling frame to the housing.

A top drive power swivel is mounted to the housing. The top drive power swivel includes a rotating drive shaft rotatable on an axis. The power swivel receives power from at least two hydraulic motors. The rotating drive shaft rotates between about 0 revolutions per minute to about 150 revolutions per minute.

A pair of sheave assemblies are mounted to the travelling frame. Each sheave assembly engages a hoisting means which can include pulleys, blocks, and wire rope or cable.

Two guide wheel assemblies are connected to the travelling frame. Each guide wheel assembly is disposed on sides of the travelling frame opposite each other. The guide wheel assembly is contemplated to be constructed from at least one wheel, and possibly 3 or more wheels, up to 10 wheels depending on the size of the travelling frame between a pair of wear pads. For any one guide wheel assembly, 3 guide wheels might be placed between two wear pads enabling the travelling frame to roll up and down the tubulars, such as on rails that communicate with the guide wheels or with tubular portions of a derrick directly.

Now the invention will be further described with reference to the Figures.

FIG. 1 depicts a front view of drilling equipment being used in the field. The specific details of the derrick and its mounting base (e.g., truck mounted, track-mounted vehicle, etc.).

Within the derrick 15 which can be a tower in another embodiment, there is a travelling frame 12 that engages tubulars 14 and 16 respectively by fitting onto rails, which are not shown, which are mounted to the tubulars or by fitting directly onto the tubulars.

The tubulars can be round, ellipsoid or square tubulars. The rails can be channel steel.

The travelling frame 12 has a housing 11. The travelling frame supports at least two sheave assemblies 50 and 52 that each engage a hoist means 103 and 105. The hoist means enable the top drive power swivel assembly to be raised and lowered substantially vertically.

At least two top travelling frame extensions and two bottom travelling frame extensions are non removably secured to the travelling frame closest to the top drive power swivel. The extensions can be welded, adhered, or otherwise fastened to the travelling frame. FIG. 1 shows an embodiment with four bottom travelling frame extensions, although in this front view, only two are shown as elements 20 and 22. Similarly, this embodiment has four top travelling frame extensions, although again, in this view only two are shown as elements 24 and 26.

The top drive power swivel 28 is secured within the travelling frame 12. The top drive power swivel 28 is attached enabling ease of drilling through many layers quicker than conventional drilling equipment.

Within the field of drilling, in general, a power swivel is a mechanical device that simultaneously suspends the weight of a drill string and provides for the rotation of the drill string beneath it. A power swivel includes a stationary part, that is coupled with a power source in this instance, two hydraulic motors and a rotating part that is coupled with a drill string. A power swivel permits a high-volume flow of drilling mud or air from the stationary part through to the rotating part without leaking.

A hydraulic motor powers the top drive power swivel 28. Shown in FIG. 6, a first and second hydraulic motor, 38 and 39 respectively operate the power swivel.

The hydraulic motors cause a drive shaft of the power swivel to rotate which is secured to a drill string. By rotating the drill string a drill bit rotates and cuts through the strata. Typical size bore holes would range from about 1.25 inches in diameter to about 6.25 inches in diameter; although larger scale equipment can be used to produce larger holes.

Conventionally, the power swivels have been secured to various devices at midpoints for use in drilling. This midpoint connection is insecure, unstable and fraught with issues of balance.

Returning to FIG. 1, the top drive power swivel 28 is securely mounted to the travelling frame using a plurality of connectors. In this front view, connectors 30 and 32 engage bottom extensions 20 and 22 respectively for the bottom extensions and connectors 33 and 34 engage top extensions 24 and 26 respectively.

The connectors can be pins, such as solid steel rods, or coated steel rods or lubricated rods which insert into eyes or openings formed in each of the extensions.

The connectors can be round or cylindrical, and can range in diameter between about 2 inches to about 6 inches. The connectors can range in length between about 5 inches to about 6 feet. The connectors can be made from hollow steel. The connectors can be coated at least partially or encapsulated such as with Teflon™ or a polyamide, like Nylon 6,6 to insure an easy fit and reduce rust. Alternatively, the connectors can be simply lubricated with an oil, like a white oil which is environmentally biodegradable for ease of insertion.

In another embodiment, one pin can engage a plurality of extensions, such as one connector like connector 30 can extend the entire width of the top drive power swivel and engage two sets of bottom extensions by passing through more than one extension via each opening. That is, several extensions can be lined up in parallel and one connector can secure all the extensions together.

It is contemplated that at least two, and maybe four or more extensions can be used to hold the top drive to the travelling frame on a top side or a bottom side. It is contemplated that different numbers of extensions and connectors can be used between the top side and the bottom side and between a left portion of a top drive power swivel and a right portion of a top drive power swivel.

The extensions can be welded or fastened to each component, the top drive power swivel or the travelling frame with bolts, adhesive, riveting, or clamps. It is contemplated to be within the scope of the invention to have different fastening schemes for each unit, for example one extension may be welded to the travelling frame while extensions to the top drive power swivel may be bolted.

Similarly, there are at least two, or more top drive extensions welded or fastened with bolts, adhesive, riveting or clamps to the top drive.

As depicted in FIG. 1, a first bottom top drive extension 40 extends vertically down from the top drive to be engaged by the pin 30. Similarly a second bottom top drive extension 42 extends vertically downward from the top drive to be engaged by pin 32. Two top drive extensions, which are not shown, extend upwardly from the top drive to be engaged by the connectors 33 and 34 respectively, which in this embodiment are pins.

Also in FIG. 1 the dead line 5 and the fast line 4 are depicted and can be used in hoisting the top drive power swivel assembly.

Figure 2:
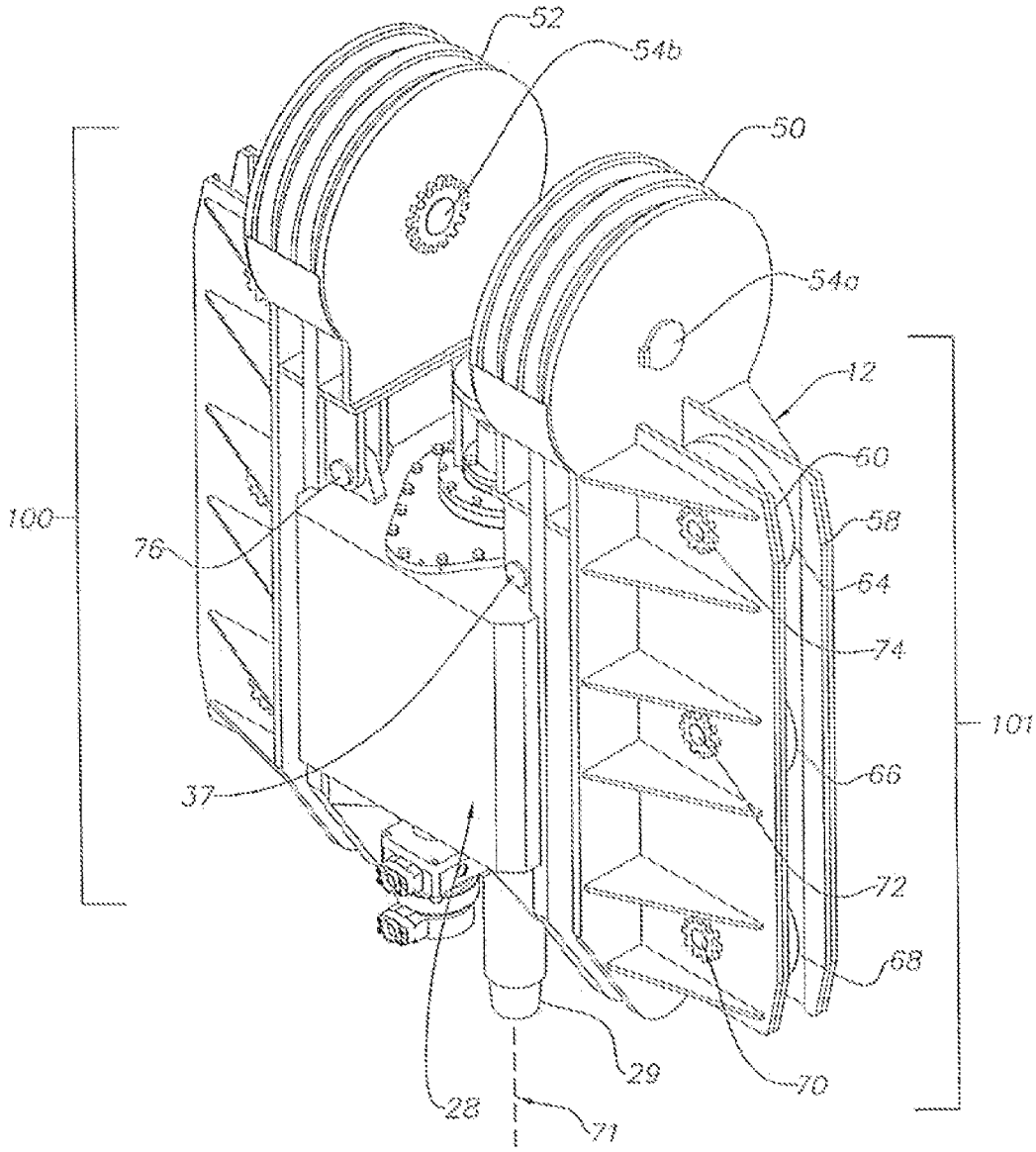
FIG. 2 is a perspective view of the components of the top drive power swivel assembly.

FIG. 2 shows another embodiment of components of the power swivel top drive assembly 28. These components include a first sheave assembly 50 and a second sheave assembly 52 but more sheave assemblies can be used.

FIG. 2 depicts a sheave assembly for each side of the top drive power swivel 28. The sheave assemblies are held to the top drive by sheave pins, 54*a* and 54*b*.

Guide wheel assemblies 100 and 101, are secured to each side of the travelling frame 12.

Interior of the guide wheel assemblies are at least one guide wheel. FIG. 2 depicts three guide wheels for each set of the guide wheel assemblies. Notably for guide wheel assembly 101, guide wheels 64, 66, and 68 are depicted. It is contemplated that between 1 guide wheel and up to 10 guide wheels can be used with the invention.

The guide wheels are held between wear pads. For guide wheel assembly 101, wear pad 58 is on one side of the wheels and wear pad 60 is located on the other side of the wheels. The wheels are positioned back from the wear pads, keeping the wheels in a crevice, or canyon, enabling the travelling frame to slide securely against the rails or tubulars.

Each wheel is affixed between the wear pads using wheel shafts, 70, 72, and 74 respectively.

It should be noted that the top drive power swivel 28 of this embodiment causes the rotating drive shaft 29 to move vertically along an axis 71. Additionally the top drive power swivel 28 is connected to the travelling frame 12 by the third connector for the top extensions 76 and a fourth connector for the top extensions 37.

The top drive power swivel has all normal major working components, such as a motor, shaft, brake assembly, bearing assembly and gooseneck fastened to the travelling frame. This top drive unit enables several lengths of standard pipe to be assembled above ground in a short drill rig.

Figure 3:
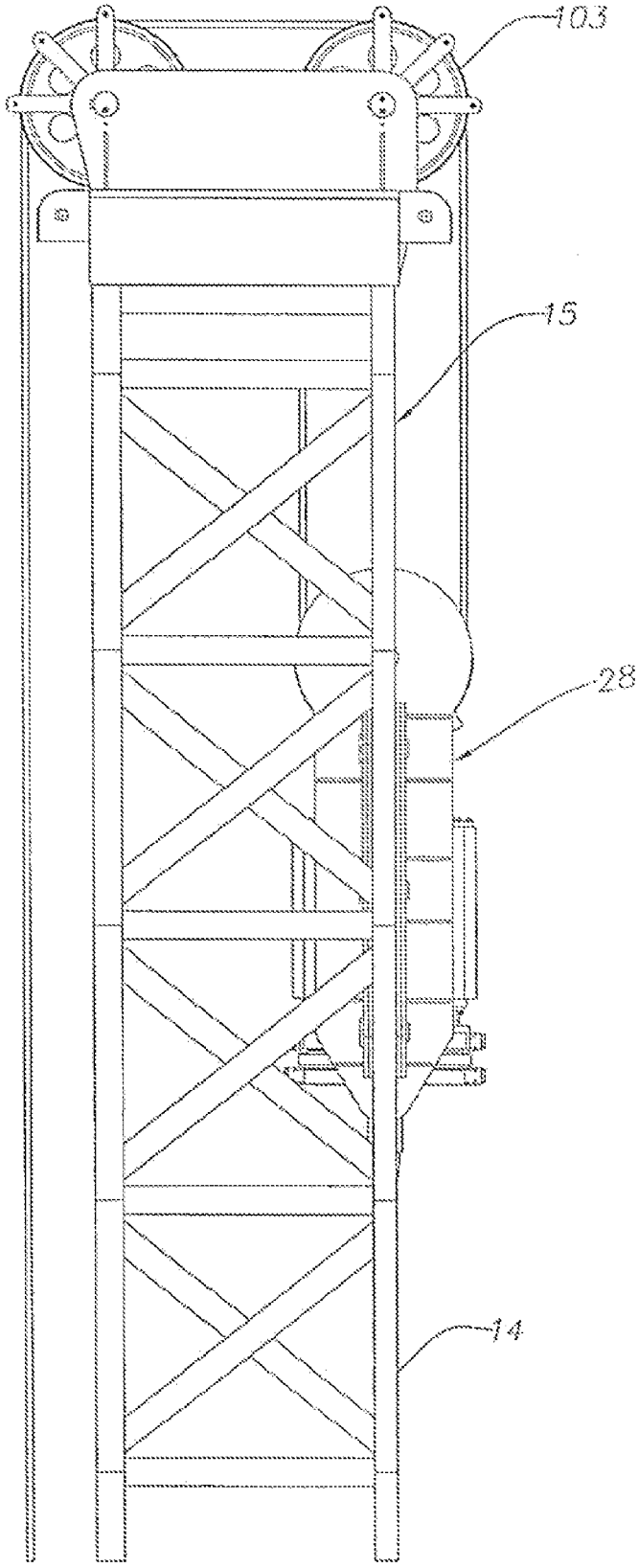
FIG. 3 is a side view of an embodiment of the top drive power swivel assembly mated to the travelling frame without connectors on a tower which is depicted as a derrick.

FIG. 3 depicts the top drive power swivel assembly 28 on the derrick 15 secured to the hoist means 103 in a side view showing tubular 14.

Figure 4:
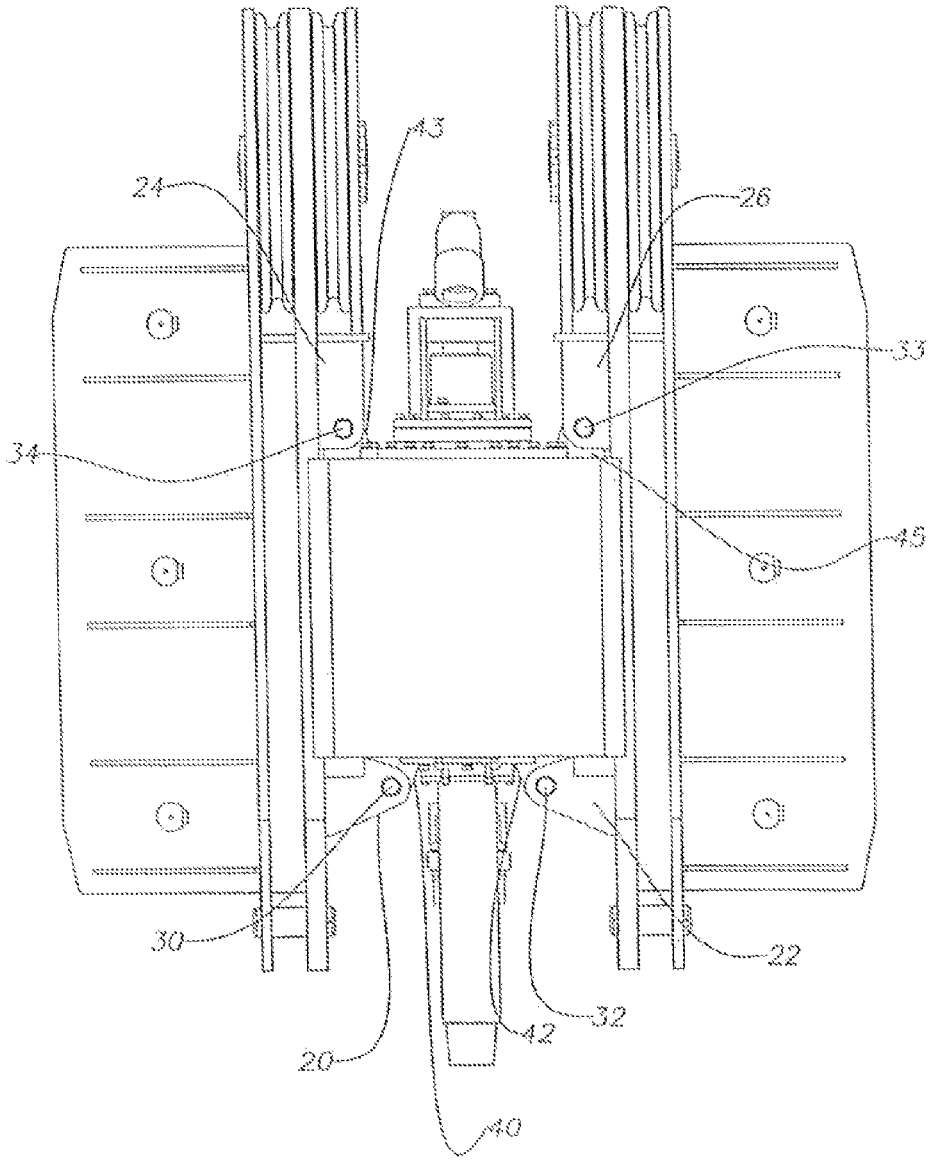
FIG. 4 is a detailed front view of an embodiment of the top drive power swivel assembly with connectors.

FIG. 4 is a detailed front view of the top drive power swivel assembly secured with eight extensions secured to the top drive, eight extensions secured to the travelling frame using eight pins to hold the two units together in an interlocking, interleaved manner. In this front detailed view only four pins can be seen. Pins 30, 32, 33 and 34 support the travelling frame extensions 20, 22, 24 and 26 to top drive extensions 40, 42, 43 and 45 respectively.

Figure 5:
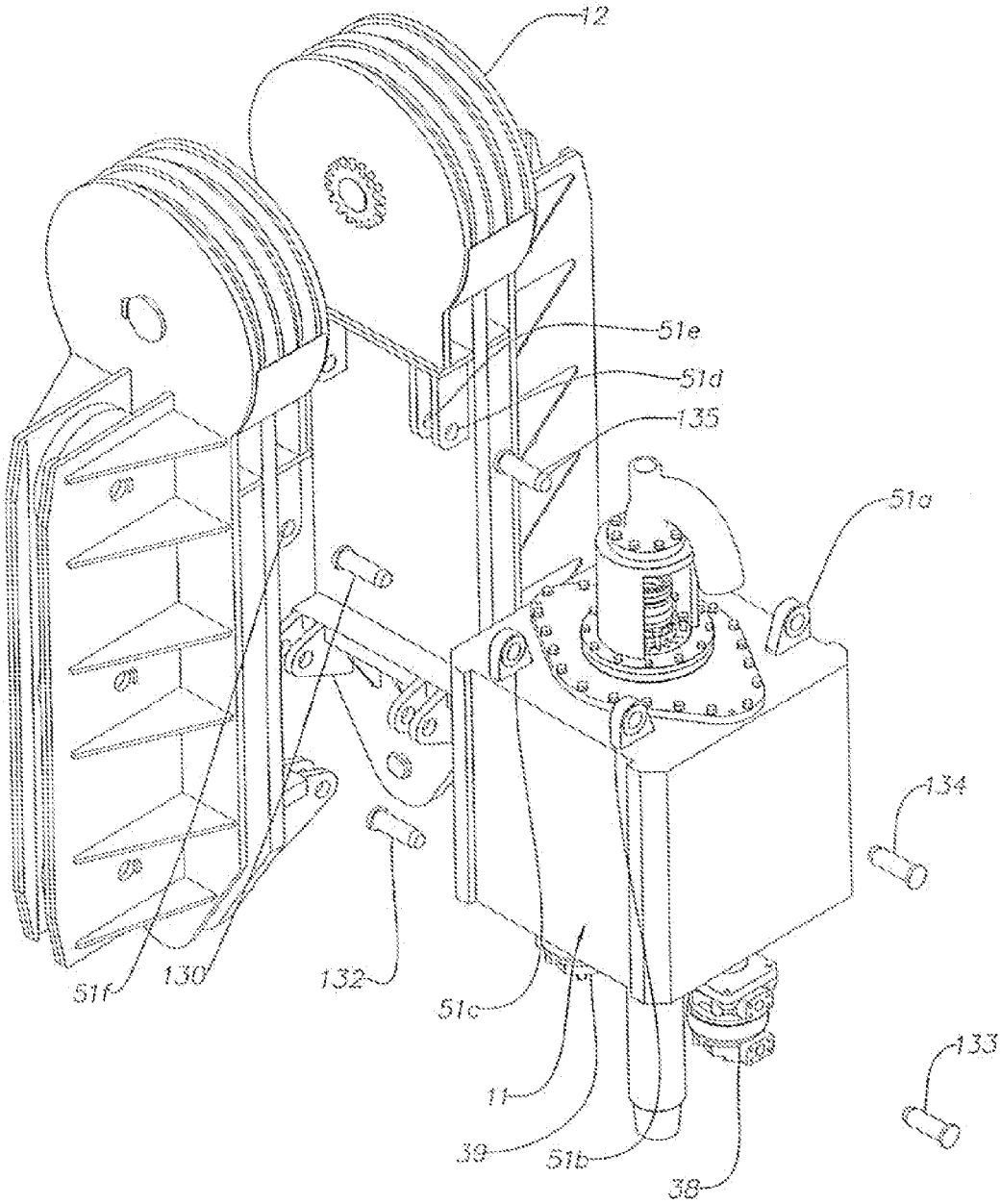
FIG. 5 is an exploded view of an embodiment of the top drive power swivel assembly attached to a travelling frame.

FIG. 5 is a detailed exploded view of the top drive power swivel. In this figure, the power swivel is shown detached from the travelling frame which is a stiff rigid assembly made of steel that rolls on the rollers along the tubulars.

In FIG. 5, the openings in the extensions can be viewed. Notably are the eyes or openings for the top extensions of the top drive power swivel, namely 51*a*, 51*b*, and 51*c*. Four extensions are presented in this embodiment, only three can be seen in this view.

The top extensions of the travelling frame depict openings 51*d*, 51*e* and 51*f*.

Embodiments of the pins usable as connectors are also shown as connectors 130, 132, 133, 134 and 135. The top drive power swivel housing 11 is easy to discern in the Figure. The two hydraulic motors 38 and 39 are also shown in this embodiment.

Figure 6:
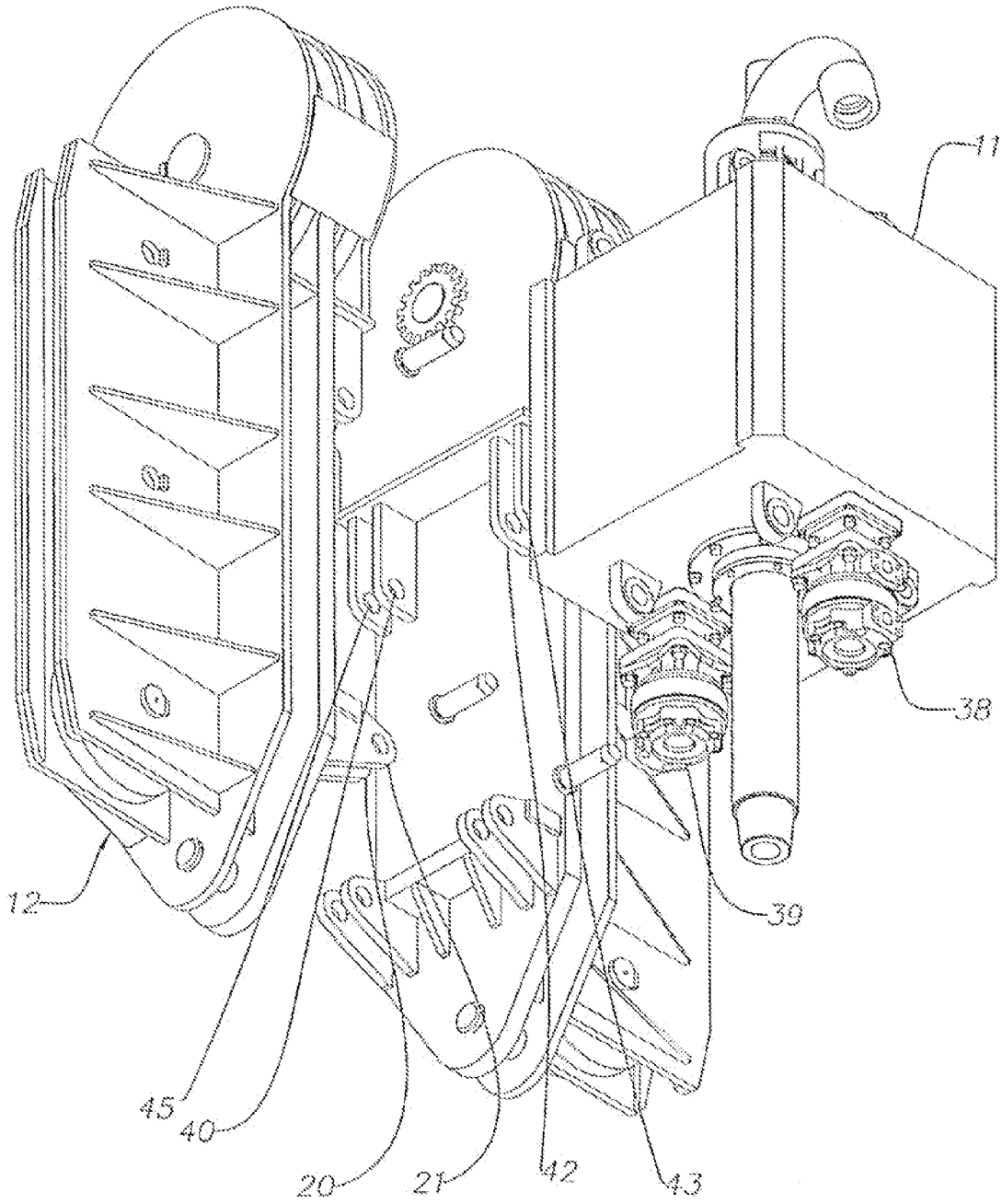
FIG. 6 is a bottom perspective view of a top drive power swivel assembly.

FIG. 6 shows a bottom perspective view of the top drive power swivel assembly with the two hydraulic motors 38 and 39 the lower housing extensions 40, 42, 43 and 45. The lower travelling frame extensions 20 and 21 are depicted as well.

In an embodiment, the first and second lower travelling frame extensions extend generally horizontally to the axis. Additionally, the first and second lower housing extensions can extend generally parallel to the axis.

In another embodiment, the first and second upper travelling frame extensions extend generally parallel to the axis. The top drive power swivel assembly can have the first and second upper housing extensions extend generally parallel to the axis. The top drive power swivel assembly can have at least one of the connectors is a pin.

The various embodiments of the swivel described herein relate to fluid drilling. The present invention can utilize water, or mud, drilling techniques as well. Similarly, air drilling, mist drilling, foam drilling and other drilling techniques are contemplated for use with the present invention.

Although the present invention has been described and illustrated in detail, it is understood that the same is by way of illustration and example only, and is not to be taken as a limitation, in scope or spirit, of the present invention which is limited only by the terms of the appended claims.

What is claimed is:

1. A top drive power swivel assembly for well drilling rigs, comprising:

a. a travelling frame for moving along at least two tubulars, wherein the at least two tubulars are part of a drilling tower, and wherein the travelling frame comprises: at least a first and second lower travelling frame extension and at least a first and second upper travelling frame extension;

b. a housing for holding a top drive power swivel, wherein the housing comprises at least a first and a second upper housing extension and at least a first and second lower housing extension;

c. a plurality of openings disposed in each of the extensions;

d. at least one upper connector for penetrating at least one opening in the at least one upper travelling frame extension and at least one opening in the at least one upper housing extension to securely engage the travelling frame to the housing and at least one lower connector for penetrating at least one opening in at least one lower travelling frame extension and at least one opening in at least one lower housing extension to securely engage the travelling frame to the housing;

e. a top drive power swivel mounted to the housing, wherein the top drive power swivel comprises a rotating drive shaft rotatable on an axis parallel to a hoisting axis, wherein the power swivel receives power from at least two hydraulic motors;

f. a plurality of sheave assemblies mounted to the travelling frame wherein each sheave assembly engages a hoisting means; and g. at least two guide wheel assemblies disposed on opposite sides of the travelling frame, wherein each guide wheel assembly engages one of the at least two tubulars.

2. The top drive power swivel assembly of claim 1, wherein the tower can be a derrick.

3. The top drive power swivel assembly of claim 2, wherein the travelling frame travels along tubulars which comprise the derrick.

4. The top drive power swivel assembly of claim 1, wherein the first and second lower travelling frame extensions extend generally horizontal to the axis.

5. The top drive power swivel assembly of claim 4, wherein the first lower housing extension and second lower housing extension extend generally parallel to the axis.

6. The top drive power swivel assembly of claim 1, wherein the first upper traveling frame extension and second upper travelling frame extension extend generally parallel to the axis.

7. The top drive power swivel assembly of claim 6, wherein the first upper housing extension and second upper housing extension extend generally parallel to the axis.

8. The top drive power swivel assembly of claim 1, wherein the plurality of openings have a diameter between about 1 inch to about 6 inches.

9. The top drive power swivel assembly of claim 1, wherein at least one of the connectors is a pin.

10. The top drive power swivel assembly of claim 9, wherein the pin is solid steel rod.

11. The top drive power swivel assembly of claim 9, wherein the pin extends across the housing to engage at least 2 housing extensions disposed in parallel with at least 2 travelling frame extensions.

12. The top drive power swivel assembly of claim 1, wherein the rotating drive shaft rotates between about 0 revolutions per minute to about 150 revolutions per minute.

13. The top drive power swivel assembly of claim 1, wherein each guide wheel assembly comprises at least one guide wheel disposed between at least two wear pads.

* * * * *